United States Patent [19]

Fluck

[11] 4,116,396

[45] Sep. 26, 1978

[54] YARN TRAVERSING APPARATUS

[75] Inventor: Jakob Fluck, Winterthur, Switzerland

[73] Assignee: Rieter Machine Works, Ltd., Winterthur, Switzerland

[21] Appl. No.: 872,430

[22] Filed: Jan. 26, 1978

[30] Foreign Application Priority Data

Feb. 4, 1977 [CH] Switzerland ..... 1353/77

[51] Int. Cl.[2] ..... B65H 54/30

[52] U.S. Cl. ..... 242/43 R; 242/157 R; 242/158.3

[58] Field of Search ..... 242/43 R, 158.3, 158.5, 242/157 R

[56] References Cited

U.S. PATENT DOCUMENTS

| | | | |
|---|---|---|---|
| 3,059,874 | 10/1962 | Hays | 242/158.3 UX |
| 3,074,286 | 1/1963 | Altice et al. | 242/43 R X |
| 3,248,064 | 4/1966 | Rollings | 242/43 R |
| 3,281,086 | 10/1966 | Goodman et al. | 242/43 R X |
| 3,401,894 | 9/1968 | Campbell, Jr. | 242/43 R |
| 3,527,423 | 9/1970 | Burow | 242/43 R |
| 3,664,596 | 5/1972 | Lenk | 242/43 R |
| 3,831,872 | 8/1974 | Fisher et al. | 242/43 R |
| 3,934,831 | 1/1976 | Bruggisser et al. | 242/43 R |

FOREIGN PATENT DOCUMENTS

| | | | |
|---|---|---|---|
| 2,109,214 | 9/1972 | Fed. Rep. of Germany | 242/43 R |
| 1,107,888 | 3/1968 | United Kingdom | 242/43 R |
| 1,138,365 | 1/1969 | United Kingdom | 242/158.3 |

*Primary Examiner*—Stanley N. Gilreath

*Attorney, Agent, or Firm*—Kenyon & Kenyon, Reilly, Carr & Chapin

[57] ABSTRACT

The yarn traversing guide is slidably mounted within a pair of slats disposed across the face of the drum housing for reciprocating motion. Each slat is provided with a rigid center section and two spring-elastically deflectable end sections. The end sections deflect to a limited degree during reversing of the high speed traversing guide without impairing the life of the traversing guide.

10 Claims, 11 Drawing Figures

YARN TRAVERSING APPARATUS

This invention relates to a yarn traversing apparatus.

As is known, various types of yarn traversing devices have been used for traversing or reciprocating a yarn or thread, for example, for winding on winding machines. Generally, these devices employ a traversing guide which meshes via a guiding shoe with an endless cam groove of a rotatably mounted drum as well as a gliding member which is guided in the direction of the traversing motion between two parallel rails. These parts are fixed, for example, with respect to a housing of the reciprocating drum.

For example, as described in Swiss Pat. No. 447,902, one particular yarn traversing device has a cam groove in the sleeve of a rotatable drum which consists of two helical grooves. The helical increments of the grooves extend in opposite directions and merge at their respective ends via an arc-shaped curve in such a manner that the yarn traversing guide is reciprocated to and fro by the drum in the direction of the traversing motion parallel to the axis of a bobbin tube onto which the yarn is wound. A guiding shoe of the yarn guide which is guided by the groove is of generally longitudinally extended shape. Thus, the shoe can pass the cross over points of the two grooves safely and without change of direction. Further, the yarn guide is provided with a rhomboid gliding member when is guided between the side surfaces of the two guide rails. In this arrangement, the gliding member can follow the change of position of the shoe at the return points of the traversing motion by tilting from one gliding position into the other. Further, the yarn traversing guide is provided with an intermediate member which is arranged between the shoe and the gliding member. This intermediate member fits exactly into the clearance between the guide rails and the drum and tangentially contacts the surface of the drum. This intermediate member is provided in order to prevent a tilting motion of the yarn traversing guide in the zone of the return points where the arc-shaped groove is enlarged.

However, practical experience has shown that an intermediate member of this type is too small to prevent a tilting motion of the yarn traversing guide. As a result, smoothness of the run and the wear life of the yarn traversing guide are not satisfactory.

As described in German DT-GM No. 6,900,984 (corresponding to U.S. Pat. No. 3,664,596) another yarn traversing apparatus which is intended to overcome these above disadvantages, has a gliding member meshing with two guide grooves which extend in mutually parallel relation to the direction of the traversing motion in the guide rails. Further, the gliding member is disposed to be tiltable in the grooves about its height axis so that tilting of the yarn traversing guide is avoided. However, this apparatus does not obtain the improvement desired. In particular, in the zone of the return points, the yarn traversing guide must take up extremely high tilting momentums, deceleration forces and acceleration forces. Thus, impacts and relatively excessive heating due to the greater friction forces are generated such that the smoothness of the run and the wear life of the traversing guide remain unsatisfactory.

Accordingly, it is an object of the invention to provide a yarn traversing apparatus which is capable of high traversing speeds.

It is another object of the invention to provide a yarn traversing apparatus which is able to operate at traversing speeds of 800 to 1,000 per minute.

It is another object of the invention to provide a yarn traversing guide which is able to run extremely smoothly at high traversing speeds.

It is another object of the invention to provide a yarn traversing guide of relatively long life for use at high speeds.

Briefly, the invention provides an apparatus for traversing a yarn across a given path on a winding machine at relatively high speeds, e.g., of 800 to 1,000 miles per minute. This apparatus comprises a housing, a drum which is rotatably mounted in the housing, a pair of parallel rails fixed to the housing and a traversing guide for traversing a yarn in the given path. The drum is provided with an endless cam groove in a surface thereof while each of the rails has a guide slat containing a rigid center section and a pair of end sections. In addition, each end section is elastically deflectable to a limited degree in a direction at right angles relative to the path in which the yarn is traversed. The traversing guide includes a gliding shoe which is slidably disposed in the cam groove of the drum and a gliding member which projects from the housing and has a pair of grooves receiving the guide rails therein for movement parallel to the yarn traversing path.

Surprisingly, the wear life of the yarn traversing guide achieves time durations heretofore unobtainable. A particularly long wear life of the yarn traversing guide can be obtained when each guide slat is rigidly connected to a rail in the center section and is disposed in a groove of the rail in each end section in spaced relation to the rail. The end sections of the guide slat are deflectable at a bias to the groove. Each guide slat, which may consist of a spring steel strip, can be adhesively bonded to the center section of a guide rail and may be additionally secured by set screws.

One particular arrangement which has proven to be particularly advantageous is one in which the guide slat is deflectable over a zone corresponding to one tenth of the length of the traversing width and is spaced on three sides from the rail at a distance equal to 0.2 millimeters.

In another embodiment, each guide slat is integral with a respective rail to form a one piece member. In this embodiment, the guide rail is formed with an elongated opening at each end to define a guide slat end section, or, in the alternative, each guide rail has a recess at each end to define a guide slat end section.

These and other objects and advantages of the invention will become more apparent from the following detailed description taken in conjunction with the accompanying drawings in which.

Figure 1:
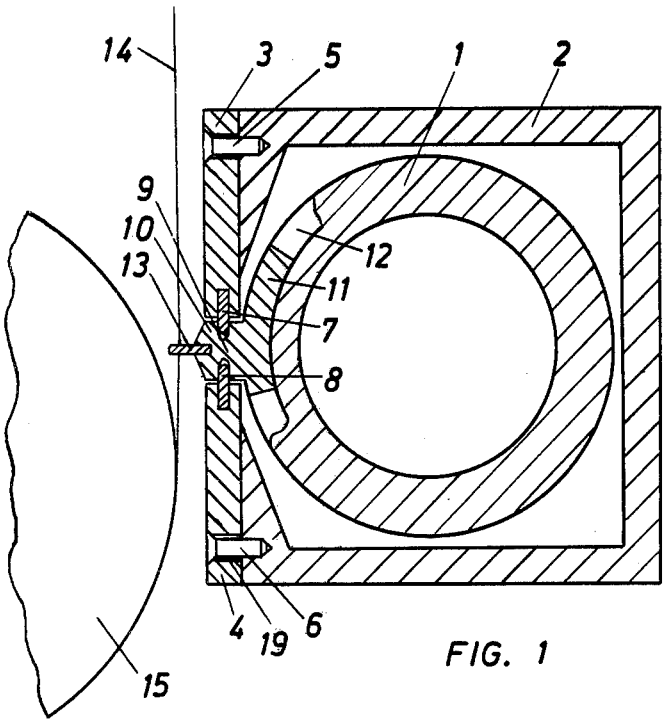
FIG. 1 illustrates a schematic cross-sectional view of a yarn traversing apparatus according to the invention.
Figure 3:
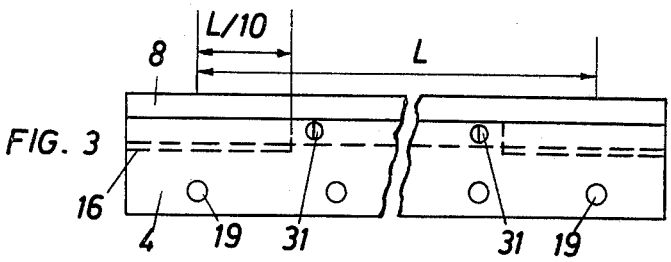
FIG. 3 illustrates a front view of a guide rail used in the apparatus of FIG. 1.
Figure 4:
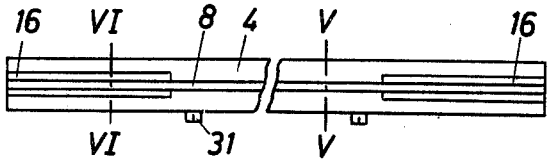
FIG. 4 illustrates a top view of the guide rail of FIG. 3.

Referring to FIG. 1, the yarn traversing apparatus includes a drum 1 which is rotatably mounted in a housing 2. As shown, a pair of guide rails 3, 4 is fixed to the housing 2 by means of screws 5, 6, which pass through bores 19 in the rails 3, 4. Each rail 3, 4 has a guide slat 7, 8 fixedly secured thereon at the parallel, mutually facing face sides of the rails 3, 4. As shown in FIGS. 3, 4, each slat (only one of which is shown for simplicity) contains a rigid center section and a pair of end sections which are disposed in spaced relation on three sides to the guide rail 4.

Figure 5:
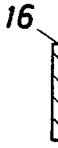
FIG. 5 illustrates a view taken on line V—V of FIG. 4.

As indicated in FIG. 5, the center section of each guide rail 3, 4 is provided with a groove 16 of rectangular cross section to receive the center section of the guide slat 8. In this regard, the cross section of the guide slat 8 corresponds to the cross section of the groove 16. In addition, the center section of the slat 8 is adhesively bonded in the groove 16, for example, by means of a two-component adhesive. In order to further secure the slat 8 in place, set screws 31 can also be threaded into the guide rail 4 within the center section.

Figure 6:
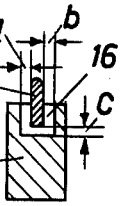
FIG. 6 illustrates a view taken on line VI—VI of FIG. 4.

As shown in FIG. 6, the groove 16 is enlarged in the end sections of the guide rail 4 such that clearances *a, b, c* are formed between the slat 8 and the rail 4. A clearance of 0.2 millimeters is very suitable on each of the three sides of the slat 8 from the guide rail 4. As such, the end sections of the guide slat 8 extend freely into the enlarged groove space. This allows each end section to be elastically deflectable to a limited degree in a direction at right angles relative to a yarn traversing path. The horizontal and vertical deflection of the end sections is indicated by the use of double arrows 17, 18, respectively in FIG. 7.

Figure 2:
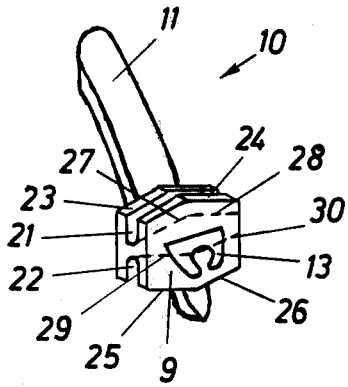
FIG. 2 illustrates an axonomeric view of the yarn traversing guide of FIG. 1.

Referring to FIGS. 1 and 2, a yarn traversing guide 10 is disposed on the drum 1 and guided between the slats 7, 8. As indicated, the yarn traversing guide 10 contains a gliding shoe 11 which is slidably disposed in a cam groove, for example, an endless helical groove 12 in the drum 1. In addition, the yarn traversing guide 10, which preferably consists of a plastic material, carries a gliding member 9 which projects from the housing 2. The gliding member 9 has guide grooves 21, 22 which receive the guide slats 7, 8 respectively therein. Still further, the traversing guide 10 has a yarn guide eyelet 13 made of ceramic material inserted in the end of the gliding member 9. This eyelet 13 guides and traverses a yarn 14 before the yarn 14 is wound onto a take-up bobbin package 15 of a winding machine (not shown).

Referring to FIG, 2, the gliding member 9 is formed with pairs of mutually parallel side faces 23, 26 and 24, 25, respectively in which the grooves 21, 22 are formed. As indicated, the bottom surfaces of the grooves 21, 22 are in the shape of a hemi-cylinder and extend parallel to the side faces 23–26 in such a manner that a cross section through the groove bottom surfaces 27, 28, 29, 30, as well as a section through the sides faces 23–26 is in the shape of a rhomboid, the points of which are cut off.

During operation, the yarn traversing guide 10 is driven by the rotation of the groove drum 1 via the gliding shoe 11. Thus, the traversing guide 10 is guided to and fro in the helical groove 12 at relatively high speed over a traversing width L (FIG. 3) parallel to the path of the traversing yarn. The yarn traversing guide 10 is further guided on the guide slats 7, 8 in the direction of the traversing motion. To this end, the guide slats 7, 8 mesh with the grooves 21, 22 of the gliding member 9 mainly on the groove side surfaces; sufficient clearance being provided between the hemi-cylindrical groove bottom surfaces 27–30 and the hemi-cylindrical face sides of the guide slats 7, 8. The side surfaces 23–26 of the gliding member 9 are not guided as a sufficient clearance is provided between these sides and the face sides of the guide rails 3, 4. At the return points, the gliding member 9 switches over from one set of parallel side surfaces and groove bottom surfaces to the other set, e.g., from the side surfaces 24, 25 and the groove bottom surfaces 28, 29 to the other mutually parallel side surfaces 23, 26 and the groove bottom surfaces 27, 30. In this way, either the surfaces 24, 25, 28, 29 or the surfaces 23, 26, 27, 30 are guided in parallel to the guide slats 7, 8 and the guide rails 3, 4. Switching over of the gliding member 9, and thus of the yarn traversing guide 10, is effected by the change of direction of the gliding shoe 11 in the helical groove 12; the gliding shoe 11 being deflected at the return points of the helical groove 12.

Since the guide slats 7, 8 are rigidly connected to the guide rails 3, 4 in the center section while being deflectable to a limited degree in the end sections, the yarn traversing guide 10 may also recede slightly in the zone of the return points of the yarn traversing guide. That is, in the zone of the return points, the yarn traversing guide 10 is still guided via the gliding member 9 on the slats 7, 8 and by the shoe 11 in the helical groove 12. The groove 12 is dimensioned to be slightly larger in the zone of the return points that the shoe 11.

Surprisingly, it has been found that an apparatus of the above construction in which the yarn traversing guide 10 can have a limited deflection and tilt, the run of the yarn traversing guide 10 is extremely smooth. The large tilting momentums, deceleration forces and acceleration forces and the friction forces generated thereby are distributed onto the guide slats 7, 8 and the helical groove 12 in such a manner that the stress at a single point of the traversing guide is relatively small. Also, a deflection in a direction at right angles to the guide slat 7, 8 caused by the greater friction forces at the return point, effects a reduction of the stress peaks in the gliding shoe 11.

Tests using the described apparatus show that the yarn traversing guide 10 has a wear life two to three times longer than conventional structures. It has also proven to be of advantage if the end section of each guide slat 7, 8 is deflectable over a length equal to one tenth the traversing width L and if the slats 7, 8 are made of spring steel strips.

Figure 7:
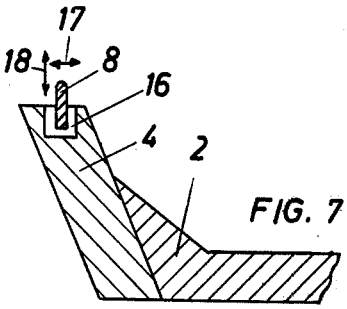
FIG. 7 illustrates a cross-sectional view of the end section of a modified guide rail in accordance with the invention.

Referring to FIG. 7, the above-described apparatus may also be employed with a drum housing 2 wherein the guide rails 4 (only one of which is shown for purposes of simplicity) are mounted at an angle. In such a case, the guide slat 8 is mounted in an inclined position within a guide rail.

Figures 8, 9:
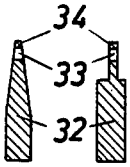
FIG. 8 illustrates a view taken on line VIII—VIII of FIG. 10.
FIG. 9 illustrates a view taken on line IX—IX of FIG. 10.
Figure 10:
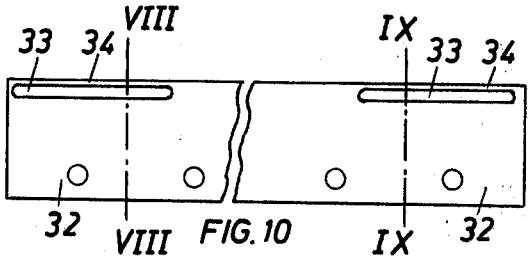
FIG. 10 illustrates a view of a guide rail having an integrated slat in accordance with the invention.

Alternatively, instead of forming the slats separately from the guide rails, the slat may be formed in an integral manner with the guide rail. For example, as shown in FIGS. 8 and 10, a guide rail 32 may be formed with an elongated opening 33 at each end section so as to define a deflectable end section of a slat 34 adjacent thereto. As shown in FIG. 8, the guide rail 32 may be tapered gradually in the direction towards the slat 34 or, as shown in FIG. 9, the guide rail 32 may be formed in a step-wise manner with the slat 34 formed in the thinner section.

Figure 11:
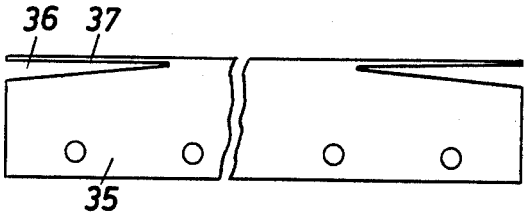
FIG. 11 illustrates a further modified guide rail having an integrated slat in accordance with the invention.

Referring to FIG. 11, a one-piece guide rail 35 may alternatively be formed with a recess 36 in each end section to form the end sections of slats 37.

The slats 34, 37 which are integrally formed with the rail (32, 35) are of such small dimensions as to be deflected in the vertical and lateral directions as viewed. Because of the one-piece construction, no fixation means are required between the slat and guide rail.

What is claimed is:

1. An apparatus for traversing a yarn across a given path on a winding machine; said apparatus comprising a housing a drum rotatably mounted in said housing, said drum having an endless cam groove in a surface thereof;

a pair of parallel rails fixed to said housing, each said rail having a guide slat thereon containing a rigid center section and a pair of end sections, each said end section being elastically deflectable to a limited degree in a direction at right angles relative to said given path; and a traversing guide for traversing a yarn in said given path, said guide including a gliding shoe slidably disposed in said cam groove of said drum and a gliding member projecting from said housing and having a pair of grooves receiving said guide slats respectively therein for movement parallel to said given path.

2. An apparatus as set forth in claim 1 wherein each guide slat is rigidly connected to a respective rail in said center section and is disposed in a groove of said respective rail in each said end section in spaced relation to said respective rail.

3. An apparatus as set forth in claim 2 wherein each guide slat is adhesively bonded to said center section of a respective guide rail.

4. An apparatus as set forth in claim 3 which further comprises set screws securing each slat to a respective guide rail in said center section.

5. An apparatus as set forth in claim 2 wherein each slat is a spring steel strip.

6. An apparatus as set forth in claim 2 wherein each end section of a respective guide slat is deflectable over a zone corresponding to one-tenth of the length of said given path.

7. An apparatus as set forth in claim 2 wherein each end section of a respective guide slat is spaced on three sides from said respective rail a distance equal to 0.2 millimeter.

8. An apparatus as set forth in claim 1 wherein each guide slat is integral with a respective rail.

9. An apparatus as set forth in claim 8 wherein each guide rail has an elongated opening at each end to define a respective guide slat end section adjacent thereto.

10. An apparatus as set forth in claim 8 wherein each guide rail has a recess at each end to define a respective guide slat end section.

* * * * *

UNITED STATES PATENT AND TRADEMARK OFFICE

CERTIFICATE OF CORRECTION

PATENT NO. : 4,116,396

DATED : September 26, 1978

INVENTOR(S) : Jakob Fluck

It is certified that error appears in the above–identified patent and that said Letters Patent are hereby corrected as shown below:

Column 1, line 29, change "when" to --which--

Column 3, line 51, after "8" insert --,--

Column 4, line 37, change "that" to --than--

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*